United States Patent [19]

Dole et al.

[11] 4,097,199

[45] Jun. 27, 1978

[54] DOUBLE ACTING RACK AND GEAR-DRIVEN PISTON PUMP

[75] Inventors: James R. Dole; Benjamin F. Blaine, both of Hutchinson, Kans.

[73] Assignee: Arrow Machine, Inc., Hutchinson, Kans.

[21] Appl. No.: 732,495

[22] Filed: Oct. 14, 1976

[51] Int. Cl.[2] ..... F04B 49/00; F04B 21/04

[52] U.S. Cl. ..... 417/286; 417/529; 417/539; 92/136

[58] Field of Search ..... 417/437, 529, 539, 286, 417/440; 92/136

[56] References Cited

U.S. PATENT DOCUMENTS

| | | | |
|---|---|---|---|
| 805,530 | 11/1905 | Davis | 417/539 |
| 1,365,506 | 1/1921 | Krieger | 417/525 |
| 1,864,609 | 6/1932 | Musolf | 417/529 |
| 2,192,175 | 3/1940 | Ballard | 92/136 |
| 2,334,383 | 11/1943 | Carr et al. | 92/136 |
| 2,680,347 | 6/1954 | Kanuch | 417/523 |
| 2,776,624 | 1/1957 | Reinhard | 417/539 |
| 2,844,128 | 7/1958 | Steiner | 92/136 |
| 3,288,035 | 11/1966 | Ryzner | 92/136 |
| 3,437,044 | 4/1969 | Sanders | 417/526 |

FOREIGN PATENT DOCUMENTS

| | | | |
|---|---|---|---|
| 1,251,645 | 12/1960 | France | 417/529 |

*Primary Examiner*—William L. Freeh
*Attorney, Agent, or Firm*—Edward L. Brown, Jr.

[57] ABSTRACT

A hand-operated hydraulic pump utilized to lift or trim an outboard marine engine. A wobble-action handle connects with a pinion gear which in turn drives a rack on a double-ended piston forming two cylinder chambers on opposite ends thereof. Reciprocal movement of the piston alternately pumps fluid from each cylinder chamber both of which are supplied by a common longitudinal passage in the piston across a pair of check valves located at each end of the piston. The pump housing includes the reservoir, discharge port and needle valve for relieving fluid from the discharge port back to the reservoir.

7 Claims, 3 Drawing Figures

DOUBLE ACTING RACK AND GEAR-DRIVEN PISTON PUMP

BACKGROUND OF THE INVENTION

The larger sized outboard marine engines of the present day have a substantial weight and for that reason are quite difficult to manually tilt or rotate out of the water when not in use. To perform this tilt function, various prior art systems, as for example U.S. Pat. No. 3,434,450, provide a hydraulic cylinder which is powered by an electrically driven pump. Typical of these systems is the above mentioned patent which includes a reversible electric motor driving a gear pump in a very complex electro-hydraulic system; as compared with the manually operated system of the present invention.

SUMMARY OF THE INVENTION

In place of the electrically powered system mentioned above, the present invention provides a manually operated hand pump. The operating handle rotates back and forth in a wobble motion, driving a pinion gear which in turn engages a gear rack on a double-ended piston. At each end of the piston is formed a separate cylinder chamber. Each cylinder chamber alternately has a pumping stroke as the piston moves back and forth in a common bore. A portion of the pump housing includes an air-tight oil reservoir connected to the pinion gear cavity so that oil can pass from the gear cavity through passages between the gear teeth in the rack to a longitudinal passage in the piston which is open at each end thereof for supplying both cylinder chambers. Positioned in the longitudinal passage of the piston are a pair of check valves preventing flow from the individual cylinder chambers back through the longitudinal passage in the piston. The cylinder chambers are in turn connected to a common discharge port of the pump unit with a second pair of check valves therebetween preventing flow from the discharge port back to the individual cylinder chambers. A needle valve connecting the discharge port with the reservoir permits drainings of a single-acting lift cylinder whenever it is desired to lower the load. Due to variable flow rate of the pump which is accurately controlled by the operating handle, the need for a complex valving circuit is eliminated.

It is therefore the principal object of the present invention to provide a simple hand-operated piston type hydraulic pump for lifting an outboard marine engine.

Another object of the present invention is to provide a hand-operated double-acting hydraulic pump with a selfcontained non-vented precharged reservoir which can be used for a variety of functions.

A further object of the invention is to provide a hand-operated accurately controlled variable flow pump.

Another object of the invention is to provide a hand-operated pump which is self-priming.

DESCRIPTION OF THE PREFERRED EMBODIMENT

Figure 3:
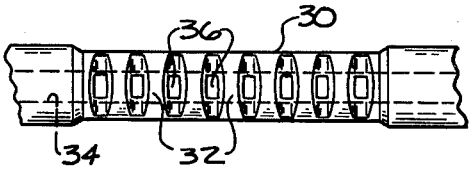
FIG. 3 is a partial top view of a modified pump piston.
Figure 1:
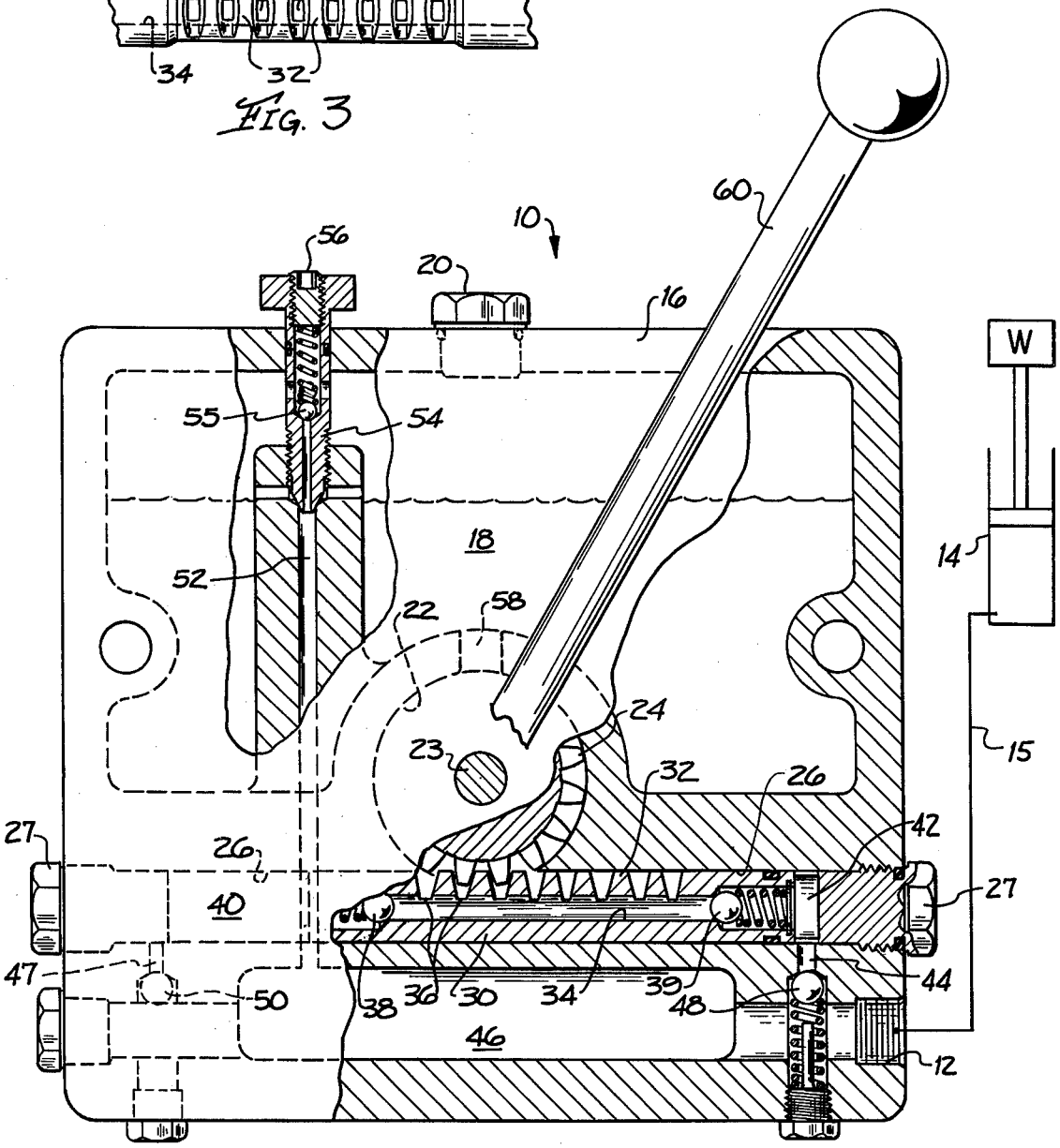
FIG. 1 illustrates a side elevational view of the pump with portions broken away in section and portions shown schematically.

Referring to the drawings, and more specifically to FIG. 1, the pump unit is generally referred to by reference numeral 10. Pump unit 10 is shown schematically attached to a single-acting cylinder 14 through line 15 and pump discharge port 12. Cylinder 14 is shown lifting a load W which can be any type of gravity load as well as an outboard engine. Pump unit 10 is made up of a housing 16 which includes a self-contained air-tight oil reservoir 18 filled by removing plug 20. Centrally disposed in housing 16 is a pinion gear cavity 22 loosely containing gear 24. Traversely positioned in housing 16 is a bore 26 closed at each end by a plug member 27. Located in bore 26 is a double-ended hollow piston 30 having a plurality of gear teeth 32 therein which are disposed longitudinally on the piston for engagement with pinion gear 24 in a conventional rack and pinion drive. Located in the center of piston 30 is a longitudinal passage 34 which extends the full length of piston 30. Located between each gear tooth 32 is an opening 36 which connects cavity 22 with longitudinal piston passage 34, as best seen in FIG. 3. Positioned in passage 34, at each end of the piston 30, are a pair of check valves 38 and 39 which prevent backflow from cylinder chambers 40 and 42 respectively, into longitudinal passage 34. Cylinder chamber 42 is connected to pump discharge passage 46 via lateral passage 44 while cylinder chamber 40 is connected to pump discharge passage 46 via lateral passage 47. Positioned in lateral passages 44 and 47 are a paid of check valves 48 and 50 respectively, which prevent flow from the pump discharge passage 46 into respective cylinder chambers 42 and 40. Pump discharge passage 46 is connected to reservoir 18 via passage 52, across a needle valve 54. Centrally positioned in needle valve 54 is a relief valve 55 which can be adjusted by the movement of set screw 56. Located in the top of pinion gear cavity 22 is a passage 58 which allows oil in reservoir 18 to flow across cavity 22, through openings 36 and into longitudinal piston passage 34. Connected to pinion gear 24, via shaft 23, is handle 60. The length of handle 60 and the diameter of piston 30 can be varied to achieve the necessary pressure levels and flows required for any particular system. A system which has a higher flow rate requirement would be better suited for the double piston unit of FIG. 2.

OPERATION OF FIG. 1

While the specific application of the pump unit of the present invention is to lift outboard marine engines, the pump unit would have qual application in numerous other systems having a low intermittent volume requirement. As viewed in FIG. 1, when pump handle 60 is rotated in a clockwise direction, piston member 30 will move to the left causing cylinder chamber 40 to decrease its volume. Due to the presence of check valve 38, fluid in cylinder chamber 40 is forced across check valve 50 into pump discharge passage 46. While cylinder chamber 40 is decreasing in volume, opposing cylinder chamber 42 is increasing in volume forcing oil to be sucked across check valve 39 from reservoir 18 via passages 58, 22, 36 and 34. When piston 30 reaches the left end of its stroke contacting plug 27, cylinder chamber 40 is at the end of its power stroke and cylinder chamber 42 has fully expanded and is ready for its power stroke. Pump handle 60 is then moved in the opposite direction (counterclockwise) causing piston 30 to move to the right causing cylinder chamber 42 to decrease in volume with oil being forced across lateral passage 44 and check valve 48 into pump discharge passage 46. While cylinder chamber 42 is on its power stroke, cylinder chamber 40 is increasing in volume, causing oil to be sucked across check valve 38 from longitudinal passage 34 into cylinder chamber 40. Piston 30 is double-acting in that for every movement of handle 60 in either direction, a power stroke results in either cylinder chamber 40 or 42. Wherever handle 60 is stopped, the hydraulic cylinder 14 will maintain that position due to the presence of check valves 48 and 50. When it is desired to lower cylinder 14, needle valve 54 is opened allowing pressure in cylinder 14 to be vented back to reservoir 18. Whenever pressure in cylinder 14 attempts to exceed the system pressure level by any means, relief valve 55 opens at a preset level, preventing over-pressure in the system. At the end of either stroke, piston 30 comes in contact with plug 27, thereby reducing the volume of either chamber 40 or 42 to a very small amount. This allows both cylinder chambers to be self-priming and it is not necessary to bleed air from the system before it will pump oil.

Oil reservoir 18 is air-tight due to the O-ring surrounding plug 20. When the reservoir is initially filled, the air space above the oil is pressurized. This positive pressure causes the reservoir to act as a pressure accumulator for oil flowing out of the reservoir. The precharge pressure is sufficient so that when the minimum oil level is reached in the reservoir a vacuum is not created. With a ventless reservoir there is no problem of leaking oil from the vent or water entering the reservoir.

Figure 2:
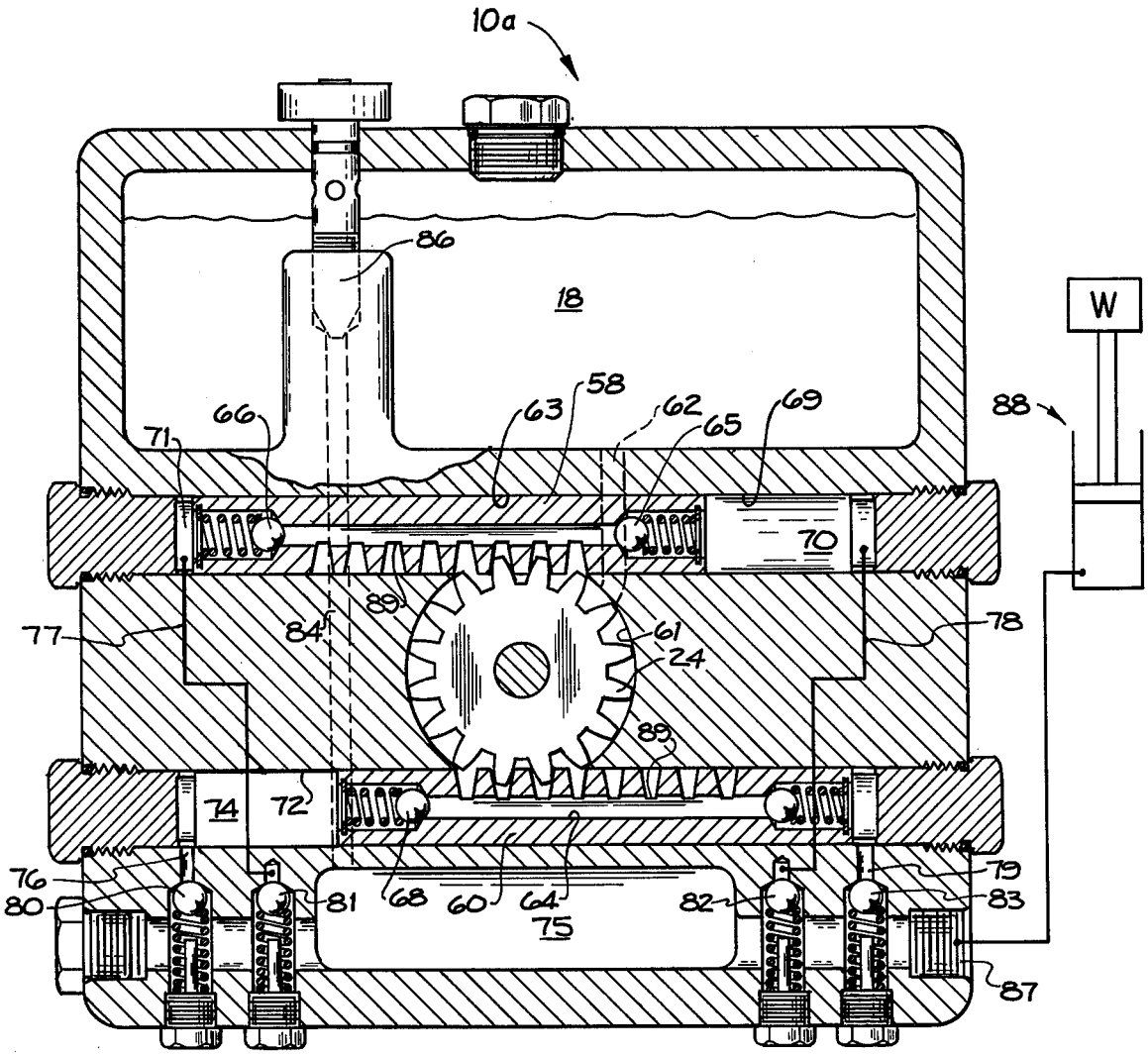
FIG. 2 is a modified form of the present invention including a dual piston arrangement.

FIG. 2 is similar to FIG. 1 except that it has a pair of pistons 58 and 60, rather than a single piston 30 as seen in FIG. 1. The pump unit, which is generally described by reference numeral 10L*a*, includes a similar pressurized reservoir 18, connected to pinion gear cavity 61 through passage 62. Pistons 58 and 60 are identical, having similar longitudinal passages 63 and 64 with check valves 65, 66, 67 and 68 respectively, located at opposite ends of each piston. Piston 58 positioned in bore 69 forms two separate cylinder chambers 70 and 71 at opposite ends thereof. Piston 60 positioned in bore 72 also forms a pair of cylinder chambers 73 and 74 at opposite ends thereof. All four of the cylinder chambers are connected to the pump discharge passage 75 through lateral passages 76, 77, 78 and 79. Positioned in each one of these lateral passages are check valves 80, 81, 82 and 83 respectively, which prevent backflow into these respective cylinder chambers. While check valves 81 and 82 are shown remotely positioned from their respective cylinder chambers 71 and 70, they are actually located in close proximity, as are checks 80 and 83, so as to decrease the dead space in the fully contracted position of the piston and allow the system to self-prime. Pump discharge passage 75 is connected to reservoir 18 through passage 84 across needle valve 86. Pump discharge port 87 supplies a single acting cylinder 88 which lifts a gravity load W. Pump unit 10 can also be used to power double-acting cylinders and rotary motors.

FIG. 2 operates in a similar manner to FIG. 1 with the addition of the second piston 58 moving in the opposite direction as piston 60. With pinion gear 24 rotating clockwise, piston 58 moves to the right while piston 60 moves to the left, simultaneously causing cylinder chambers 70 and 74 to contract and force fluid across check valves 82 and 80 while cylinder chambers 71 and 73 are expanding. Expanding chambers 71 and 73 cause fluid to be sucked acros check valves 66 and 67 from reservoir 18 via passages 62, 61, 89, 64 and 63. Pinion gear 24, in FIG. 2, is shown without its manual operating handle so as to better illustrate the inner structure of unit 10*a*. When pinion gear 24 is rotated in the opposite direction (counterclockwise) cylinder chambers 71 and 73 perform their power strokes while cylinder chambers 70 and 74 expand and refill with oil. Since the volume of each cylinder chamber at the beginning of its suction stroke is essentially zero, the unit is self-priming. Lift cylinder 88 is lowered by opening needle valve 86 and allowing fluid to return to reservoir 18.

FIG. 3 shows a modified piston, in that the diameter of the piston is slightly reduced approximate the gear teeth 32. When the O-rings are located in the bore 26, rather than in the piston 30, as shown in FIG. 1, the reduced diameter section allows the unit to be more easily assembled, without the gear teeth 32 catching on the O-ring.

Having described the invention with sufficient clarity to enable those familiar with the art to construct and use it, we claim:

1. A hand-driven hydraulic pump and reservoir adapted to drive fluid motors comprising:

a housing;

an oil reservoir and a pump discharge port in the housing;

at least one cylinder bore in the housing;

a piston positioned in the bore forming two separate cylinder chambers one at each end thereof, a plurality of gear teeth disposed longitudinally on said piston forming a rack, a longitudinal passage through the piston supplying both cylindrical chambers and providing the sole inlet for the cylinder chambers;

a pinion gear mounted in the housing engaging said rack for driving the piston in a reciprocal motion;

handle means connected to said pinion gear;

first passage means in the housing connecting each cylinder chamber to the pump discharge port;

first check valve means positioned in each of the first passage means blocking flow from the discharge port to each separate cylinder chamber;

second passage means connecting the reservoir to each of the cylinder chambers through said longitudinal passage;

second check valve means positioned in each of the second passage means blocking flow from each of the cylinder chambers to the reservoir;

and relief valve means connecting the pump discharge port to reservoir which can be opened to allow return flow to the reservoir.

2. A hydraulic pump as set forth in claim 1, wherein the longitudinal passage through the piston forms a portion of the second passage means, and lateral passages in the piston between the gear teeth connecting the longitudinal passage with the reservoir.

3. A hydraulic pump as set forth in claim 1, wherein the oil reservoir is an airtight chamber which is precharged creating a positive pressure in the reservoir at all working levels of the reservoir.

4. A hydraulic pump as set forth in claim 1, wherein the piston has a reduced diameter portion approximate the gear teeth thereon.

5. A hand-driven hydraulic pump and reservoir adapted to drive fluid motors comprising:

a housing;

an oil reservoir and a pump discharge port in the housing;

a pinion gear cavity in the housing;

a pair of cylinder bores in the housing positioned on opposite sides of the gear cavity;

a pair of pistons, one positioned in each bore, forming four separate cylinder chambers one at each end of each piston, a plurality of gear teeth disposed longitudinally on each piston forming a rack, a longitudinal passage through each piston supplying each cylindrical chamber and providing the sole inlet for the cylinder chambers;

a pinion gear mounted in the gear cavity engaging the gear teeth on both pistons in a driving relation for reciprocal motion with one piston moving in the opposite direction from the other piston;

handle means connected to said pinion gear;

first passage means in the housing connecting each cylinder chamber to the pump discharge port;

first check valve means positioned in each of the first passage means blocking flow from the discharge port to each separate cylinder chamber;

second passage means connecting the reservoir to each of the cylinder chambers;

second check valve means positioned in each of the second passage means blocking flow from each of the cylinder chambers to the reservoir; and relief valve means connecting the pump discharge port to reservoir which can be opened to allow return flow to the reservoir.

6. A hydraulic pump as set forth in claim 5, the second check valve means includes four check valves two positioned in each longitudinal passage, one at each end of each piston, and lateral passages in the piston between the gear teeth connecting the longitudinal passage with the pinion gear cavity and an opening between the gear cavity and the reservoir.

7. A hydraulic pump as set forth in claim 1, the second passage means including: a pinion gear cavity in the housing opening into said reservoir; the longitudinal passage through the piston and lateral passages in the piston between the gear teeth and the longitudinal passage; thereby allowing flow from the reservoir to both cylinder chambers.

* * * * *